US007044143B2

(12) United States Patent
DeYoung et al.

(10) Patent No.: US 7,044,143 B2
(45) Date of Patent: May 16, 2006

(54) DETERGENT INJECTION SYSTEMS AND METHODS FOR CARBON DIOXIDE MICROELECTRONIC SUBSTRATE PROCESSING SYSTEMS

(75) Inventors: James P. DeYoung, Durham, NC (US); James B. McClain, Raleigh, NC (US); Stephen M. Gross, Chapel Hill, NC (US)

(73) Assignee: Micell Technologies, Inc., Raleigh, NC (US)

( * ) Notice: Subject to any disclaimer, the term of this patent is extended or adjusted under 35 U.S.C. 154(b) by 313 days.

(21) Appl. No.: 10/259,066

(22) Filed: Sep. 27, 2002

(65) Prior Publication Data

US 2003/0033676 A1 Feb. 20, 2003

Related U.S. Application Data

(63) Continuation-in-part of application No. 09/570,224, filed on May 12, 2000, now Pat. No. 6,499,322, which is a continuation-in-part of application No. 09/312,556, filed on May 14, 1999, now Pat. No. 6,148,645.

(51) Int. Cl.
*B08B 3/10* (2006.01)

(52) U.S. Cl. ..... 134/105; 134/108; 134/94.1; 134/100.1

(58) Field of Classification Search ..... 134/902, 134/111, 105, 107, 108, 94.1, 99.1, 99.2, 134/100.1
See application file for complete search history.

(56) References Cited

U.S. PATENT DOCUMENTS

| | | | | |
|---|---|---|---|---|
| 3,653,234 A | | 4/1971 | Gillespie | 68/12 R |
| 5,213,619 A | * | 5/1993 | Jackson et al. | 134/1 |
| 5,267,455 A | * | 12/1993 | Dewees et al. | 68/5 C |
| 5,344,493 A | * | 9/1994 | Jackson | 134/1 |
| 5,412,958 A | | 5/1995 | Iliff et al. | 68/5 |
| 5,467,492 A | | 11/1995 | Chao et al. | 8/159 |
| 5,669,251 A | | 9/1997 | Townsend et al. | 68/58 |
| 5,683,977 A | | 11/1997 | Jureller et al. | 510/286 |
| 5,759,209 A | * | 6/1998 | Adler et al. | 8/142 |
| 5,772,783 A | * | 6/1998 | Stucker | 134/12 |
| 5,772,784 A | * | 6/1998 | Mohindra et al. | 134/21 |
| 5,784,905 A | | 7/1998 | Townsend et al. | 68/13 R |
| 5,789,505 A | * | 8/1998 | Wilkinson et al. | 526/209 |
| 5,822,818 A | * | 10/1998 | Chao et al. | 8/158 |
| 5,868,856 A | * | 2/1999 | Douglas et al. | 134/2 |
| 5,881,577 A | * | 3/1999 | Sauer et al. | 239/136 |
| 5,904,737 A | | 5/1999 | Preston et al. | 8/158 |
| 5,943,721 A | | 8/1999 | Lerette et al. | 8/158 |

(Continued)

FOREIGN PATENT DOCUMENTS

WO WO 97/33031 9/1997

(Continued)

OTHER PUBLICATIONS

International Search Report dated Sep. 11, 2000; International Application No. PCT/US00/13103.

(Continued)

*Primary Examiner*—Frankie L. Stinson
(74) *Attorney, Agent, or Firm*—Myers Bigel Sibley & Sajovec

(57) ABSTRACT

Microelectronic substrate processing systems include a microelectronic substrate processing chamber that is configured to contain therein at least one microelectronic substrate. A carbon dioxide supply system is configured to supply densified carbon dioxide to the microelectronic substrate processing chamber. A detergent supply system is configured to supply detergent to the microelectronic substrate processing chamber.

17 Claims, 6 Drawing Sheets

U.S. PATENT DOCUMENTS

| | | | | |
|---|---|---|---|---|
| 5,953,780 | A | 9/1999 | Schollmeyer et al. | 8/158 |
| 5,970,554 | A | 10/1999 | Shore et al. | 8/158 |
| 5,976,264 | A * | 11/1999 | McCullough et al. | 134/2 |
| 6,045,588 | A * | 4/2000 | Estes et al. | 8/142 |
| 6,073,292 | A * | 6/2000 | Lindqvist et al. | 8/158 |
| 6,092,538 | A * | 7/2000 | Arai et al. | 134/1.3 |
| 6,129,451 | A * | 10/2000 | Rosio et al. | 366/173.2 |
| 6,240,936 | B1 * | 6/2001 | DeSimone et al. | 134/33 |
| 6,306,564 | B1 * | 10/2001 | Mullee | 430/329 |
| 6,442,980 | B1 * | 9/2002 | Preston et al. | 134/107 |
| 6,461,387 | B1 * | 10/2002 | Jureller et al. | 8/142 |
| 6,481,247 | B1 * | 11/2002 | Fedegari | 68/18 C |
| 6,499,322 | B1 * | 12/2002 | DeYoung et al. | 68/18 R |
| 6,576,066 | B1 * | 6/2003 | Namatsu | 134/30 |
| 6,612,317 | B1 * | 9/2003 | Costantini et al. | 134/58 R |
| 6,737,225 | B1 * | 5/2004 | Miller | 430/329 |
| 6,764,552 | B1 * | 7/2004 | Joyce et al. | 134/3 |
| 6,802,961 | B1 * | 10/2004 | Jackson | 210/86 |
| 6,821,356 | B1 * | 11/2004 | Wandke et al. | 134/33 |

FOREIGN PATENT DOCUMENTS

| | | |
|---|---|---|
| WO | WO99/10587 | 3/1999 |
| WO | WO99/34937 | 7/1999 |
| WO | WO 99/49122 | 9/1999 |

OTHER PUBLICATIONS

Shaffer II et al., *On the Mechanical Integrity of Ultra-Low Dielectric Constant Materials for Use in BEOL Structures*, Advanced Electronics Materials, MRS Spring 2000, Apr. 25, 2000, pp. 1-24.

* cited by examiner

DETERGENT INJECTION SYSTEMS AND METHODS FOR CARBON DIOXIDE MICROELECTRONIC SUBSTRATE PROCESSING SYSTEMS

CROSS-REFERENCE TO RELATED APPLICATIONS

This application is a continuation-in-part of patent application Ser. No. 09/570,224, filed May 12, 2000, now U.S. Pat. No. 6,499,322, entitled Detergent Injection Systems For Carbon Dioxide Cleaning, which itself is a continuation-in part of application Ser. No. 09/312,556, filed 14 May 1999, now U.S. Pat. No. 6,148,645, entitled Detergent Injection Systems For Carbon Dioxide Cleaning Apparatus, assigned to the assignee of the present application, the disclosures of both of which are hereby incorporated herein by reference in their entirety as if set forth frilly herein.

FIELD OF THE INVENTION

This invention relates to microelectronic substrate fabrication systems and methods, and more particularly to cleaning systems and methods for microelectronic substrates.

BACKGROUND OF THE INVENTION

Many traditional solvent-based cleaning applications can suffer from poor performance on aqueous born soils. A significant portion of the soils found in conventional dry cleaning can be categorized as partially or wholly water-soluble. Water-in-oil surfactants have been developed that effectively disperse water to yield optically clear homogeneous mixtures. These dispersions can effectively dissolve water-soluble soils, termed secondary solublization, if the proper water activity is achieved in a given cleaning solvent. Water activity, determined by a number of factors including temperature, the nature of solvent-solute interactions and the molar ratio of surfactant to water, is generally monitored in conventional dry cleaning by what is termed as relative humidity. A cleaning bath with low relative humidity and hence low water activity will not allow for secondary solublization of aqueous born soils. Water exceeding a critical level can lead to non-dispersed bulk water that can be deleterious to certain garment types.

Carbon dioxide based dry cleaning is a new technology that has only recently been commercially implemented. Like conventional dry cleaning solvents water-soluble soils are not inherently soluble in liquefied carbon dioxide. Surfactant systems that enable the water bearing nature of liquid carbon dioxide have been disclosed in the patent and open literature. Under certain conditions these systems have demonstrated that water-soluble materials can be dissolved and dispersed in a liquid carbon dioxide medium.

Many conventionally used water-in-oil surfactants applied to dry cleaning solvents are not compatible with liquid $CO_2$ solvent systems. Surfactants containing what is termed to be "$CO_2$-philic" function have been proven to be useful in the emulsification of water in $CO_2$. The exclusive use of some of these materials can be cost prohibitive for many applications. The case for dissolution of water-soluble materials in $CO_2$ can be further complicated by the reversible reaction between water and carbon dioxide producing carbonic acid. This weak acid which reverts back to water and carbon dioxide as pressure is lowered and $CO_2$ is removed can have substantial implications on water activity in $CO_2$. Lower water activity can effect the ability of the $CO_2$ cleaning fluid to dissolve water-soluble soils. Certain pH buffers have been used in liquid and supercritical $CO_2$ to control the pH of aqueous micro and macro-domains and in turn augment water activity. Attempts to raise the water activity in current processes by the addition of bulk water can fail because of the inability of the $CO_2$ and surfactant combinations to sufficiently stabilize the water. Bulk water phase-separated from liquid $CO_2$ cleaning fluids and conventional cleaning fluids can have substantial detrimental effects on many dry clean only fabrics.

Not all stains are water soluble. Indeed, a significant number of stains that must be cleaned in a dry cleaning operation are hydrophobic. Thus, in addition to aqueous detergent formulations, it is also desirable to have a means for adding low water content detergent formulations to carbon dioxide dry cleaning systems.

U.S. Pat. No. 5,858,022 to Romack et al. and U.S. Pat. No. 5,683,473 to Jureller et al. (see also U.S. Pat. No. 5,683,977 to Jureller et al.) describe carbon dioxide dry cleaning methods and compositions. Our co-pending U.S. patent application Ser. No. 09/047,013 of McClain et al., filed Mar. 24, 1998, describes carbon dioxide dry cleaning apparatus. Dry cleaning apparatus is also described in U.S. Pat. Nos. 5,467,492 to Chao et al. 5,651,276 to Purer et al., and 5,784,905 to Townsend et al.

Cleaning may present unique challenges in the fabrication of microelectronic substrates. For example, the fabrication of integrated circuits may involve tens or hundreds of processing steps. Of these steps, it has been estimated that about one in four may be a cleaning step.

As used herein, the term "microelectronic substrates" includes integrated circuit wafers, integrated circuit chips, microelectromechanical (MEM) substrates, optical substrates, optoelectronic substrates, nanotechnology substrates, other substrates that include features that are on the order of microns or less in size, and/or combinations thereof. These substrates may be fabricated from silicon, silicon carbide, gallium nitride, other single element or compound semiconductor materials, glass, metal, organic compounds and/or combinations thereof. Microelectronic substrates may include a plurality of layers thereon that may be formed by deposition, etching, sputtering, self-assembly and/or other techniques.

It is known to use liquid and/or supercritical carbon dioxide, together referred to herein as "densified" carbon dioxide, in microelectronic substrate cleaning. In particular, production of microelectronic substrates may involve multiple processing steps, many of which incorporate water as either a carrier of chemistry, or a media to facilitate the removal of process byproducts. The evolution of materials and processes has been lead by a drive toward smaller feature sizes and more complex microdevices. In some cases, the use of water in these evolving processes has resulted in challenges whereby deleterious effects of water and byproducts carried by water have been seen. The unique physical properties of densified carbon dioxide in a liquid and/or supercritical state are of particular interest in preventing certain of these pitfalls.

One such process where densified $CO_2$ is of practical application relates to prevention of surface tension or capillary force induced image collapse. This may be of particular interest during the aqueous development of micro-lithographic images using photoresists. Photoresists are photosensitive films used for transfer of images to a substrate. A coating layer of a photoresist is formed on a substrate and the photoresist layer is then exposed, through a photomask or by other techniques, to a source of activating radiation. Exposure to activating radiation provides a photoinduced chemical transformation of the photoresist coating to thereby transfer the pattern of the photomask (or other pattern generator) to the photoresist coated substrate. Following exposure, the photoresist is developed to provide a relief image that permits selective processing of a substrate. See. e.g., U.S. Pat. No. 6,042,997.

Capillary forces present in the aqueous drying of imaged resist patterns can result in resist deformation and pattern collapse. This problem becomes particularly serious as lithography techniques move toward smaller image nodes with larger aspect ratios. Researchers have suggested that collapse problems associated with aqueous drying will affect the 130-nm technology node, and will become more prevalent in subsequent technologies as aspect ratios increase.

Researchers at both IBM and NTT have suggested that the use of carbon dioxide in supercritical resist drying (SRD) may reduce image collapse and film damage. See, e.g., H. Namatsu, *J. Vac. Sci. Technol. B* 18(6), 3308–3312 (2000); D. Goldfarb et al., *J. Vac. Sci. Technol B.* 18(6) 3313–3317 (2000). However, while the absence of surface tension and the accessible critical temperature and pressure of $CO_2$ have been touted as positives factors for this drying approach, the relatively low solubility of water in the supercritical phase has also been described as a challenge that may necessitate the use of chemical adjuncts to increase the transport capacity of the fluid.

Another potential problem with drying of surfaces on microelectronic substrates is the complete removal of aqueous processing, cleaning or rinsing solutions without leaving a residue, commonly referred to as a drying watermark. These watermarks result from the concentration of solutes in the aqueous processing, cleaning, or drying fluid, as said fluid is dried. In many microelectronic structures this watermark can negatively impact the manufacturing yield or ultimate performance of the device. It is desirable to have an effective method to remove (clean) water-based fluids from surfaces that eliminates the concentration and ultimate deposition of entrained solutes—eliminating watermarks.

One such challenge comes in the manufacturing of MEMs devices. Wet-processing steps generally culminate with a rinse and dry step. Evaporative drying causes water with low levels of solutes that is pooled on the surface and in various micro-features to concentrate in locations that maximize the surface area of the pool. As a result, these drying steps can lead to the concentration of once dissolved solutes in close proximity to or on motive parts. The deposited materials, which can be organic or inorganic in nature, contribute to stiction, the locking of the motive part such that it cannot be actuated. "Release stiction" as it is termed during the manufacturing step results, is believed to be derived from adhesive and Van der Waals forces and friction. The forces generated by this phenomenon can completely incapacitate motive parts on MEMs devices.

To combat stiction, manufacturers of MEMs devices use solvents such as small chain alcohols that reduce surface tension during the rinse step and facilitate a more even drying process. However, these steps alone apparently have not eliminated the occurrence of stiction. Supercritical $CO_2$ has been proposed for drying microstructures, (see Gregory T. Mulhern "Supercritical Carbon Dioxide Drying of Micro Structures") where surface tension forces can cause damage. Researchers at Texas Instruments Inc. among others (see, e.g., U.S. Pat. No. 6,024,801) have demonstrated that supercritical $CO_2$ can be used to clean organic and inorganic contaminants from MEMs devices prior to a pacification step, thus limiting stiction.

Other examples of drying and cleaning challenges related to aqueous wet-processing steps come in the formation of deep vias for interlayer metallization in the production of integrated circuits. These vias, formed by methods known to those familiar with the art, typically have large aspect ratios, creating geometries that can be difficult to clean residues from. Furthermore, wet-processing steps and rinses with traditional fluids such as water leave once dissolved solutes behind upon evaporative drying. These solutes deposited at the bottom of the vias can inhibit conduction upon metallization lowering functional yields.

Systems and methods for cleaning of microelectronic structures using densified carbon dioxide also are described in application Ser. No. 09/951,247 entitled Methods for the Control of Contaminants Following Carbon Dioxide Cleaning of Microelectronic Structure, filed Sep. 13, 2001 to DeYoung et al., assigned to the assignee of the present application, the disclosure of which is hereby incorporated herein by reference in its entirety as if set forth fully herein.

SUMMARY OF THE INVENTION

A first aspect of the present invention provides systems for the controlled addition of detergent formulations and the like to a carbon dioxide cleaning apparatus. These systems preferably comprise:

(a) a microelectronic substrate processing chamber that is configured to contain therein at least one microelectronic substrate;
(b) an auxiliary vessel;
(c) a drain line connecting the auxiliary vessel to the microelectronic substrate processing chamber;
(d) a separate vent line connecting the auxiliary vessel to the microelectronic substrate processing chamber;
(e) a detergent reservoir;
(f) a detergent supply line connecting the detergent reservoir to the auxiliary vessel; and
(g) a drain control system operatively associated with the drain line and configured to control a time of draining of detergent formulation from the auxiliary vessel into the microelectronic substrate processing chamber.

These systems may allow the detergent to be added to the microelectronic substrate processing chamber in a predetermined aliquot or amount based, for example, on the volume of the auxiliary vessel, so that an accurate and precise amount can then be added to the microelectronic substrate processing chamber by the drain control system. An accurate and/or precise amount of detergent thereby can be added. These embodiments of the invention also can allow detergent to be added to the auxiliary vessel prior to addition of densified carbon dioxide under substantially higher pressures in the microelectronic substrate processing chamber. Thus, the addition of the detergent need not be performed using a high pressure pump which can be costly.

A second aspect of the present invention provides methods for the controlled addition of a detergent formulation to carbon dioxide microelectronic processing systems. These methods comprise:

(a) reducing the pressure in the microelectronic substrate processing chamber and the auxiliary vessel; then
(b) adding a detergent formulation to the auxiliary vessel; then
(c) increasing the pressure in the microelectronic substrate processing chamber so that carbon dioxide can be pumped therethrough to clean the at least one microelectronic substrate in the microelectronic substrate processing chamber; and then (d) transferring the detergent formulation from the auxiliary vessel to the microelectronic substrate processing chamber to facilitate the cleaning of the at least one microelectronic substrate.

A third aspect of the present invention is systems for the addition of aqueous detergent formulations to a carbon dioxide microelectronic substrate processing system under turbulent conditions. These systems comprise:

(a) a microelectronic substrate processing chamber that is configured to contain therein at least one microelectronic substrate;

(b) a filter;

(c) a carbon dioxide cleaning solution drain line interconnecting the microelectronic substrate processing chamber to the filter;

(d) a carbon dioxide cleaning solution supply line connecting the filter to the microelectronic substrate processing chamber;

(e) a first high pressure densified transfer system (i.e., a pump that is capable of pumping densified solutions comprising densified carbon dioxide) operably associated with the drain line;

(f) a detergent formulation reservoir;

(g) a detergent formulation supply line connecting the reservoir to the carbon dioxide cleaning solution supply line or drain line; and (h) a second high pressure densified transfer system operably connected to the detergent formulation supply line and configured to transfer detergent formulation from the detergent formulation reservoir into the carbon dioxide cleaning solution under turbulent conditions.

These systems can provide for the introduction of detergent formulations under turbulent conditions, which can facilitate the mixing of the formulations with the densified carbon dioxide. Such a manner of introduction may be particularly advantageous when the detergent formulation is immiscible, wholly or in part, with the densified carbon dioxide and/or where dissolution or emulsification may require dynamic mixing. Some of these embodiments can allow a detergent to be mixed with densified carbon dioxide at conditions that are consistent with a desired processing environment, while reducing or eliminating the need to use a separate mixing vessel. Moreover, the addition of the detergent formulation under turbulent conditions to the carbon dioxide cleaning solution supply line with fluid flow leading to the filter, can allow a resident volume for mixing to be provided in the filter along with a tortuous path to enhance mixing. These embodiments can provide a homogenous mixture and reduce or prevent exposure of the microelectronic substrate to non-homogeneous conditions. Moreover, in some embodiments, the first high pressure pump provides a fluid flow and motive force to the substrate. These hydrodynamic forces can enhance the cleaning process. Highly filtered fluid also may be provided to the surface of the microelectronic substrate in these environments.

A fourth aspect of the present invention provides methods for the addition of aqueous detergent formulations to a carbon dioxide microelectronic substrate processing system under turbulent conditions. In some embodiments, these methods may be carried out with systems as described immediately above. These methods comprise:

(a) providing a microelectronic substrate processing chamber and a filter;

(b) pumping a continuous stream of densified carbon dioxide cleaning solution from the microelectronic substrate processing chamber through the filter and back to the microelectronic substrate processing chamber to clean at least one microelectronic substrate in the microelectronic substrate processing chamber; and (c) adding a detergent formulation into the continuous stream of densified carbon dioxide to introduce the detergent formulation into the continuous stream.

The systems described above may be provided independently in a cleaning apparatus, or may be combined together in a cleaning apparatus to provide the capability of both manners of detergent introduction.

A fifth aspect of the present invention provides microelectronic substrate processing systems that include a microelectronic substrate processing chamber that is configured to contain therein at least one microelectronic substrate. A carbon dioxide supply system is configured to supply densified carbon dioxide to the microelectronic substrate processing chamber. A detergent supply system is configured to supply detergent to the microelectronic substrate processing chamber. In some embodiments, the microelectronic substrate processing chamber includes a supply line. In some embodiments, the carbon dioxide supply system is configured to supply densified carbon dioxide to the microelectronic substrate processing chamber via the supply line, and the detergent supply system also is configured to supply detergent to the microelectronic substrate processing chamber via the supply line. In other embodiments, the microelectronic substrate processing chamber includes a first supply line and a second supply line. In some embodiments, the carbon dioxide supply system is configured to supply densified carbon dioxide to the microelectronic substrate processing chamber via the first supply line, and the detergent supply system is configured to supply detergent to the microelectronic substrate processing chamber via the second supply line. In other embodiments, the carbon dioxide supply system is configured to supply densified carbon dioxide to the microelectronic substrate processing chamber via the first supply line and the detergent supply system is configured to supply detergent to the microelectronic substrate processing chamber via the first supply line and via the second supply line. Accordingly, separate carbon dioxide supply systems and detergent supply systems are provided for a microelectronic substrate processing chamber in these embodiments.

DETAILED DESCRIPTION OF THE INVENTION

Figure 1:
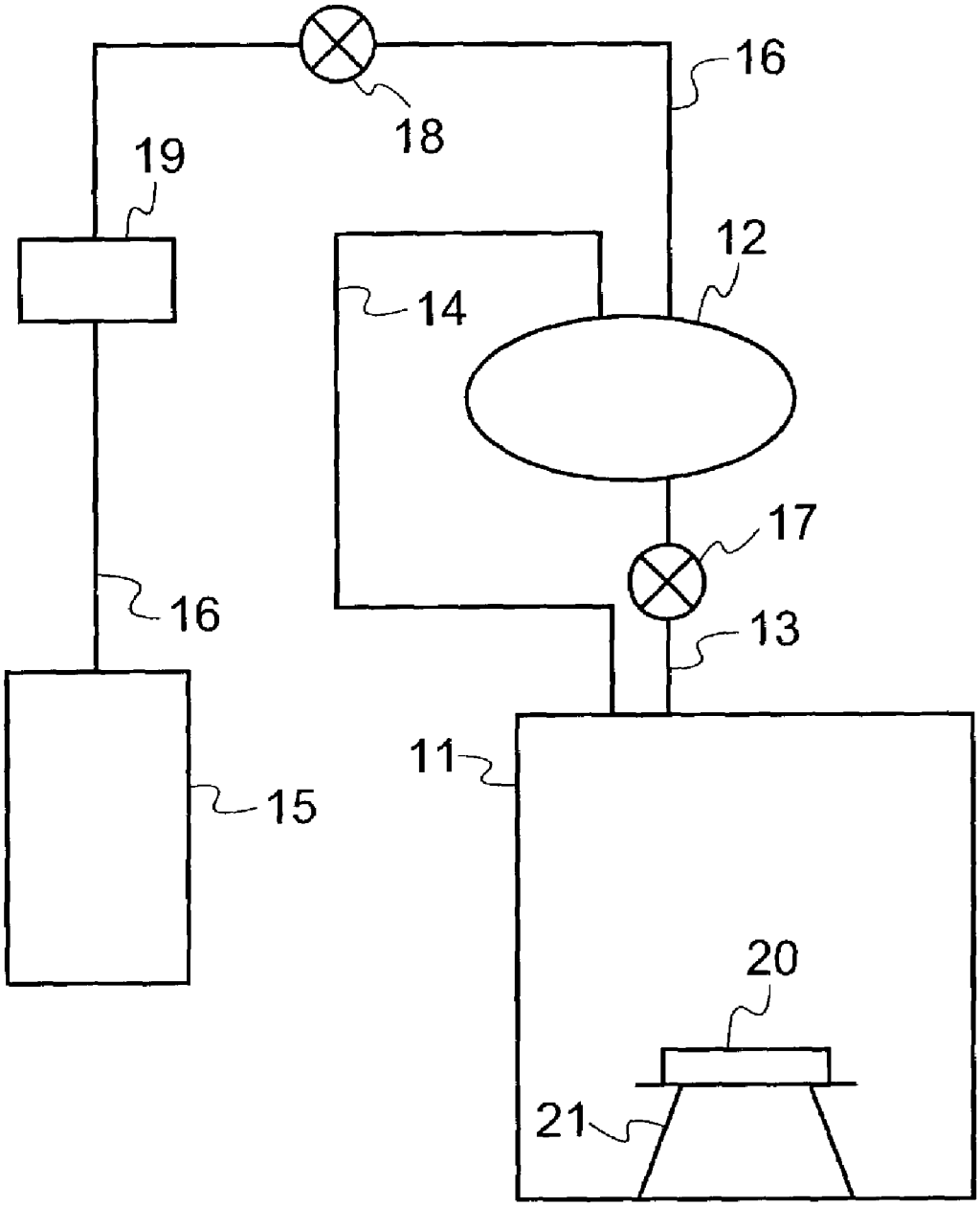
FIG. 1 schematically illustrates an apparatus for the controlled introduction of detergent formulations into the microelectronic substrate processing chamber of a carbon dioxide cleaning apparatus.

The present invention now will be described more fully hereinafter with reference to the accompanying drawings, in which embodiments of the invention are shown. However, this invention should not be construed as limited to the embodiments set forth herein. Rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout. It will be understood that when an element is referred to as being "on" another element, it can be directly on or extend directly onto the other element or intervening elements may also be present. In contrast, when an element is referred to as being "directly on" another element, there are no intervening elements present. Detergent formulations described herein are combined with densified carbon dioxide (which may also contain surfactants and other previously added ingredients) to provide densified carbon dioxide-based microelectronic substrate cleaning compositions. In some embodiments, these detergent formulations may comprise:

(a) from 0% to about 99.9% of a co-solvent or a mixture of co-solvent. Other embodiments may include between about 10% and about 98% of a co-solvent or mixture of co-solvents. Still other embodiments may include between about 70% and about 95% of a co-solvent or mixture of co-solvents;

(b) from 0% to about 20% of a surfactant. In other embodiments, from 0% to about 5% surfactant is provided; and (c) between 0% to about 10% water. In some embodiments, 0% water is provided.

Additional ingredients such as peroxide, acids and/or amines also can be included. Many embodiments of co-solvents may be provided according to embodiments of the invention. In some embodiments, these co-solvents include methyl alcohol, isopropyl alcohol, 1,3-propane diol, octanol, propylene carbonate, (gamma) butyrolactone, dimethyl sulfoxide, and n-methyl pyrolidone, and/or dipropylene glycol monomethyl ether. Other co-solvents also may be provided.

Surfactants according to some embodiments of the invention may include materials containing $CO_2$-philic segments (tails) and CO2-phobic segments (heads). CO2-philic groups include fluorocarbons, poly (ether-carbonates), or siloxane based materials. CO2-phobic head groups can include phosphate-based, sulfate-based, sulfonate-based, carbonate-based, ammonium-based, poly(ethylene oxide)-based, polystyrene-based, and/or poly(propylene oxide)-based groups.

Percentages herein are expressed as percentages by weight unless otherwise indicated. In some embodiments, the composition is provided in liquid form at ambient, or room, temperature, which will generally be between about 0° and about 50° Centigrade. The composition is held at a pressure that maintains it in liquid form within the specified temperature range. The cleaning step is preferably carried out with the composition at ambient temperature.

1. Organic Co-solvents.

Other embodiments of co-solvents now will be described. The co-solvent is, in general, a hydrocarbon co-solvent. Typically the co-solvent is an alkane co-solvent, with $C_{10}$ to $C_{20}$ linear, branched, and cyclic alkanes, and mixtures thereof (preferably saturated) currently preferred. The organic co-solvent preferably has a flash point above 140° F., and more preferably has a flash point above 170° F. The organic co-solvent may be a mixture of compounds, such as mixtures of alkanes as given above, or mixtures of one or more alkanes. Additional compounds such as one or more alcohols (e.g., from 0 or 0.1 to 5% of a C1 to C15 alcohol (including diols, triols, etc.)) different from the organic co-solvent may be included with the organic co-solvent.

Examples of suitable co-solvents include, but are not limited to, aliphatic and aromatic hydrocarbons, and esters and ethers thereof, particularly mono and di-esters and ethers (e.g., EXXON ISOPAR L, ISOPAR M, ISOPAR V, EXXON EXXSOL, EXXON DF 2000, CONDEA VISTA LPA-170N, CONDEA VISTA LPA-210, cyclohexanone, and dimethyl succinate), alkyl and dialkyl carbonates (e.g., dimethyl carbonate, dibutyl carbonate, di-t-butyl dicarbonate, ethylene carbonate, and propylene carbonate), alkylene and polyalkylene glycols, and ethers and esters thereof (e.g., ethylene glycol-n-butyl ether, diethylene glycol-n-butyl ethers, propylene glycol methyl ether, dipropylene glycol methyl ether, tripropylene glycol methyl ether, and dipropylene glycol methyl ether acetate), lactones (e.g., (gamma) butyrolactone, (epsilon)caprolactone, and (delta) dodecanolactone), alcohols and diols (e.g., 2-propanol, 2-methyl-2-propanol, 2-methoxy-2-propanol, 1-octanol, 2-ethyl hexanol, cyclopentanol, 1,3-propanediol, 2,3-butanediol, 2-methyl-2,4-pentanediol) polydimethylsiloxanes (e.g., decamethyltetrasiloxane, decamethylpentasiloxane, and hexamethyldisloxane), amines (e.g., dimethyl amine, morpholine, ethanolamine) and partially fluorinated alkyl ethers, etc.

2. Surfactants.

Other embodiments of surfactants now will be described. Any surfactant can be used to carry out the present invention, including both surfactants that contain a $CO_2$-philic group (such as described in PCT Application WO96/27704) linked to a $CO_2$-phobic group (e.g., a lipophilic group) and (more preferably) conventional surfactants, or surfactants that do not contain a $CO_2$-philic group (i.e., surfactants that comprise a hydrophilic group linked to a hydrophobic (typically lipophilic) group). A single surfactant may be used, or a combination of surfactants may be used.

Numerous surfactants are known to those skilled in the art. See, e.g., McCutcheon's Volume 1: Emulsifiers & Detergents (1995 North American Edition) (MC Publishing Co., 175 Rock Road, Glen Rock, N.J. 07452). Examples of the major surfactant types that can be used to carry out the present invention include the: alcohols, alkanolamides, alkanolamines, alkylaryl sulfonates, alkylaryl sulfonic acids, alkylbenzenes, amine acetates, amine oxides, amines, sulfonated amines and amides, betaine derivatives, block polymers, carboxylated alcohol or alkylphenol ethoxylates, carboxylic acids and fatty acids, diphenyl sulfonate derivatives, ethoxylated alcohols, ethoxylated alkylphenols, ethoxylated amines and/or amides, ethoxylated fatty acids, ethoxylated fatty esters and oils, fatty esters, fluorocarbon-based surfactants, glycerol esters, glycol esters, hetocyclic-type products, imidazolines and imidazoline derivatives, isethionates, lanolin-based derivatives, lecithin and lecithin derivatives, lignin and lignin derivatives, maleic or succinic anhydrides, methyl esters, monoglycerides and derivatives, olefin sulfonates, phosphate esters, phosphorous organic derivatives, polyethylene glycols, polymeric (polysaccharides, acrylic acid, and acrylamide) surfactants, propoxylated and ethoxylated fatty acids alcohols or alkyl phenols, protein-based surfactants, quaternary surfactants, sarcosine derivatives, silicone-based surfactants, soaps, sorbitan derivatives, sucrose and glucose esters and derivatives, sulfates and sulfonates of oils and fatty acids, sulfates and sulfonates, ethoxylated alkylphenols, sulfates of alcohols, sulfates of ethoxylated alcohols, sulfates of fatty esters, sulfonates of benzene, cumene, toluene and xylene, sulfonates of condensed naphthalenes, sulfonates of dodecyl and tridecylbenzenes, sulfonates of naphthalene and alkyl naphthalene, sulfonates of petroleum, sulfosuccinamates, sulfosuccinates and derivatives, taurates, thio and mercapto derivatives, tridecyl and dodecyl benzene sulfonic acids, etc.

Additional examples of surfactants that can be used to carry out the present invention include alcohol and alkylphenol polyalkyl ethers(e.g., TERGITOL 15-S-3™ secondary alcohol ethoxylate, TRITON X-207™ dinonylphenot ethoxylate, NEODOL 91-2.5™ primary alcohol ethoxylate, RHODASURF BC-410™ isotridecyl alcohol ethoxylate, RHODASURF DA-630™ tridecyl alcohol ethoxylate) alkylaryl carbonates, including salts and derivatives thereof (e.g., acetic acid, MARLOWET 4530™ dialkylphenol polyethylene glycol acetic acid, MARLOWET 1072™ alkyl polyethylene glycol ether acetic acid), alkoxylated fatty acids (e.g., NOPALCOL 1-TW™ diethylene glycol monotallowate, TRYDET 2600™ polyoxyethylene (8) monostearate), alkylene oxide block copolymers (e.g., PLURONIC™ and TETRONIC™ products), acetylenic alcohols and diols (e.g., SURFYNOL™ and DYNOL™ products), mono- and diesters of sulfosuccinic acid (e.g., AEROSOL OT™ sodium dioctyl sulfosuccinate, AEROSOL IB-45™ sodium diisobutyl sulfosuccinate, MACKANATE DC-50™ dimethicone copolyol disodium sulfosuccinate, SOLE TERGE-8™ oleic acid isopropanolamide monoester of sodium sulfosuccinate), sulfosuccinamic acid and esters thereof (e.g. AEROSOL 18™ disodium-N-octadecyl sulfosucciniamate, AEROSOL 22™ tetrasodium N-(1,2-dicarboxyethyl)-N octadecyl sulfosuccinamate) sorbitan esters including derivatives thereof (e.g., SPAN 80™ sorbitan monoleate, ALKAMULS 400-DO™ sorbitan dioleate, ALKAMULS STO™ sorbitan trioleate, TWEEN 81™ polyoxyethylene (5) sorbitan monoleate, TWEEN 21™ polyoxyethylene (4) sorbitan monolaurate), isothionates including derivatives thereof (e.g., GEROPON AC-270™ sodium cocoyl isothionate), polymeric alkylaryl compounds and lignins, including derivatives thereof (e.g., LIGNOSITE 50™ calcium lignosulfonate), alkylaryl sulfonic acids and salts thereof (e.g., CALIMULSE EM-99™ branched dodecylbenzene sulfonic acid, WITCONATE C-50H™ sodium dodecylbenzene sulfonate, WITCONATE P10–59™ amine salt of dodecylbenzene sulfonate), sulfonated amines and amides (e.g., CALIMULSE PRS™ isopropylamine sulfonate), Betaine and sultaine derivatives, and salts thereof (e.g., lauryl sulfobetaine, dodecyldimethyl(3-sulfopropyl)ammonium hydroxide, FOAMTAIN CAB-A™ cocamidopropyl betaine ammonium salt, FOAMTAINE SCAB™ cocamidopropyl hydroxy sultaine), e.g., imidazolines including derivatives thereof (e.g., MONOAZOLINE O™ substituted imidazoline of oleic acid, MONOAZOLINE T™ substituted imidazoline of Tall Oil), oxazolines including derivatives thereof (e.g., ALKATERGE E™ oxazoline derivative, ALKATERGE T-IV™ ethoxylated oxazoline derivative), carboxylated alcohol or alkylphenol ethoxylates including derivatives thereof (e.g., MARLOSOL OL7™ oleic acid polyglycol ester), diphenyl sulfonates including derivatives thereof (e.g., DOWFAX™ detergent diphenyl oxide disulfonate, DOWFAX™ dry detergent: sodium n-hexadecyl diphenyl oxide disulfonate, DOWFAX™ Dry hydrotrope: sodium hexyl diphenyloxide disulfonate) fluorinated surfactants (e.g., FLUORAD FC-120™ ammonium perfluoroalkyl sulfonate, FLUORAD FC-135™ fluoroalkyl quaternary ammonium iodides, FLUORAD FC-143™ ammonium perfluoroalkyl carboxylates), lecithins including lecithin derivatives (e.g., ALCOLEC BS™ soy phosphatides), phosphate esters (e.g., ACTRAFOS SA-216™ aliphatic phosphate ester, ACTRAFOS 110™ phosphate ester of complex aliphatic hydroxyl compound, CHEMPHOS TC-310™ aromatic phosphate ester, CALGENE PE-112N™ phosphated mono- and diglycerides), sulfates and sulfonates of fatty acids (e.g., ACTRASOL PSR™ sulfated castor oil, ACTRASOL SR75™ sulfated oleic acid), sulfates of alcohols (e.g., DUPONOL C™ sodium lauryl sulfate, CARSONOL SHS™ sodium 2-ethyl-1-hexyl sulfate, CALFOAM TLS-40™ triethanolamine lauryl sulfate), sulfates of ethoxylated alcohols (e.g., CALFOAM ES-301™ sodium lauryl ether sulfate), amines, including salts and derivatives thereof (e.g., Tris(hydroxymethyl)aminomethane, ARMEEN™ primary alkylamines, ARMAC HT™ acetic acid salt of N-alkyl amines) amide sulfonates (e.g, GEROPON TC-42™ sodium N-coconut acid-N-methyl taurate, GEROPON TC 270™ sodium cocomethyl tauride), quaternary amines, including salts and derivatives thereof (e.g., ACCOSOFT 750™ methyl bis (soya amidoethyl)-N-polyethoxyethanol quaternary ammonium methyl sulfate, ARQUAD™ N-alkyl trimethyl ammonium chloride, ABIL QUAT 3272™ diquatemary polydimethylsiloxane), amine oxides (e.g., AMMONYX CO™ cetyl dimethylamine oxide, AMMONYX SO™ stearamine oxide), esters of glycerol, sucrose, glucose, sarcosine and related sugars and hydrocarbons including their derivatives (e.g., GLUCATE DO™ methyl glucoside dioleate, GLICEPOL 180™ glycerol oleate, HAMPOSYL AL-30™ ammonium lauroyl sarcosinate, HAMPOSYL M™ N-myristoyl sarcosine, CALGENE CC™ propylene glycol dicaprylate/dicaprate), polysaccharides including derivatives thereof (e.g., GLUCOPON 225 DK™ alklyl polysaccharide ether), protein surfactants (e.g., AMITER LGS-2™ dioxyethylene stearyl ether diester of N-lauroyl-L-glutamic acid, AMISOFT CA™ cocoyl glutamic acid, AMISOFT CS 11™ sodium cocoyl glutamate, MAYTEIN KTS™ sodium/TEA lauryl hydrolyzed keratin, MAYPON 4C™ potassium cocoyl hydrolyzed collagen), and including thio and mercapto derivatives of the foregoing (e.g., ALCODET™ polyoxyethylene thioether, BURCO TME™ ethoxylated dodecyl mercaptan), etc.

Thus the present invention may be carried out using conventional surfactants, including but not limited to the anionic or nonionic alkylbenzene sulfonates, ethoxylated alkylphenols and ethoxylated fatty alcohols described in Schollmeyer German Patent Application DE 39 04514 A1, that are not soluble in liquid carbon dioxide and which could not be utilized in the invention described in U.S. Pat. No. 5,683,473 to Jureller et al. or U.S. Pat. No. 5,683,977 to Jureller et al.

As will be apparent to those skilled in the art, numerous additional ingredients can be included in the cleaning formulations, including oxidants such as organic and inorganic peroxides, acids weak and strong, such as HF, HF salts, phosphoric acid, sulfuric acid, organic and inorganic bases, and chelants, such as hexafluoroacetylacetonate.

3. Microelectronic Substrate Processing Chamber.

Any suitable microelectronic substrate processing chamber may be employed that can contain liquid and/or supercritical carbon dioxide, in which chamber a microelectronic substrate is positioned on a suitable support. The support may be configured to position one or more microelectronic substrates that are oriented horizontally and/or vertically in the chamber. The chamber may include a door, a stirring device or other means of agitation, a view window, a compressor connected to the chamber to increase or decrease the pressure therein, a heat exchanger, heater or cooler connected to the chamber to increase or decrease the temperature of the continents thereof. It also will be understood that in some embodiments, the microelectronic substrate processing chamber may be a specialized chamber that is uniquely configured for cleaning. In other embodiments, the microelectronic substrate processing chamber may be a dual-mode or multi-mode processing chamber that is configured for cleaning and to perform additional microelectronic substrate fabrication processes, such as deposition, etching, implantation, etc. A suitable microelectronic substrate processing chamber is described in the above-cited application Ser. No. 09/951,247.

4. Low-Water Detergent Formulations.

As noted above, in some embodiments of the invention the detergent formulation is low in water content, or substantially nonaqueous. Low-water content detergent formulations for carrying out the present invention can comprise, by weight:

(a) from 0% to about 99.9% co-solvent (and in some embodiments, between about 10% and about 98%, and in other embodiments between about 70% and about 95% co-solvent) (which may be one or more organic solvents);

(b) from 0% to about 20% surfactant (in some embodiments 0% to about 5%); and (c) not more than about 10% water. In some embodiments, the formulation may be free of water (or nonaqueous).

Additional adjuncts useful in these formulations include peroxides, acids and/or amines.

5. Apparatus for Adding Low-Water Detergent Formulations.

As noted above, embodiments of the present invention provide systems for the controlled addition of detergent formulations to a carbon dioxide microelectronic substrate processing apparatus. As illustrated in FIG. 1, these systems can comprise a high pressure microelectronic substrate processing chamber 11 (i.e., a microelectronic substrate processing chamber that is capable of containing densified carbon dioxide), an auxiliary vessel 12, and a drain line 13 connecting the auxiliary vessel to the microelectronic substrate processing chamber 11. The microelectronic substrate processing chamber 11 is configured to hold one or more microelectronic substrates 20, using, for example, a conventional support 21. The auxiliary vessel 12 is positioned above the microelectronic substrate processing chamber 11 so that the contents of the auxiliary vessel can be transferred by gravity to the microelectronic substrate processing chamber. Alternatively the auxiliary vessel could be positioned below the microelectronic substrate processing chamber and the contents thereof transferred to the microelectronic substrate processing chamber by means of a pump. Optionally, but preferably, a vent line 14 connects the auxiliary vessel to the microelectronic substrate processing chamber to provide gas-side communication therebetween (i.e., the point of connection of the vent line to each vessel is above the fill level therein). This facilitates the transfer of the contents of the auxiliary vessel to the microelectronic substrate processing chamber.

A detergent reservoir 15 is provided, and a detergent supply line 16 is provided connecting the detergent reservoir to the auxiliary vessel. Valves 17, 18 are provided to control the system, as discussed in greater detail below.

A pump 19, which is preferably an inexpensive, low pressure pump, is provided to fill the auxiliary vessel from the detergent reservoir. Other mechanisms could also be employed. For example, the detergent reservoir could be positioned above the auxiliary vessel and the auxiliary vessel gravity filled from the reservoir.

In operation, the aforesaid apparatus provides methods for the controlled addition of a low-water content detergent formulation to a carbon dioxide microelectronic substrate processing system. In general, valve 17 is closed to fill the auxiliary vessel and opened to empty the auxiliary vessel into the microelectronic substrate processing chamber. Valve 18 is opened to fill the auxiliary vessel, but closed when the pressure in the microelectronic substrate processing chamber is increased to prevent back pressure from reaching the detergent reservoir. These methods involve, initially, reducing the pressure in the microelectronic substrate processing chamber and the auxiliary vessel. The pressure may be wholly or partially reduced, but is preferably reduced to atmospheric pressure at the time the microelectronic substrate processing chamber is opened to remove the microelectronic substrates 20 and/or insert new microelectronic substrates 20 to be cleaned. Then, a detergent formulation or the like such as described above or below (and preferably a formulation that does not contain more than 10 percent water), is transferred into the auxiliary vessel from reservoir 15 by means of pump 19. Preferably, the pressure in the microelectronic substrate processing chamber is then increased so that densified carbon dioxide can be pumped therethrough to clean the substrate(s) in the microelectronic substrate processing chamber. The detergent formulation is then transferred from the auxiliary vessel to the microelectronic substrate processing chamber to facilitate the cleaning of substrates therein. Densified carbon dioxide cleaning solution can be separately pumped into and/or cycled through the microelectronic substrate processing chamber, before or after the detergent formulation has been transferred from the auxiliary vessel to the microelectronic substrate processing chamber.

6. Aqueous Detergent Formulations.

As noted above, some embodiments of the present invention provide aqueous based detergent compositions and their method of introduction into densified carbon dioxide microelectronic substrate cleaning systems and methods. The composition and method of application of these materials can provide for improved water-soluble cleaning in carbon dioxide microelectronic substrate cleaning. These compositions can be injected automatically or by choice into densified carbon dioxide wash fluid during a cleaning process which may or may not contain surfactants, co-solvents, and other adjuncts previously disclosed. The method of injection can be a factor in determining the effectiveness of the aqueous cleaning, as can be the composition of the injected detergent. Some formulations have already been described and will not be repeated for the sake of brevity.

7. Apparatus for Adding Aqueous Detergent Formulations.

In general, a desired mode of injection into the machine is carried out during the cleaning. In some embodiments, the addition of the detergent may be accomplished in a fashion to produce copious mixing of the detergent with the $CO_2$ containing fluid prior to exposure of the microelectronic substrates to be cleaned. Useful components to this end include but are not limited to static mixers, dynamic mixers, centrifugal pumps, pressure drop orifices, pipe constrictions, narrow sections of tubing, control valves, and additional equipment beneficial in providing high shear mixing. The sheared fluid composed of the densified $CO_2$, water, surfactants, cosolvents and adjuncts is exposed to the microelectronic substrates to be cleaned. The formulations are typically used at levels between 0.1 and 10% of the total densified $CO_2$ volume and preferably between 0.2 and 2.0%.

It is an additional component of this invention that temperature also can be used to control the cleaning. The "tunable" nature of liquid and supercritical carbon dioxide is well known. The solubility of water in $CO_2$ varies considerably as a function of temperature. With this feature the aqueous detergent can be injected to the machine at a temperature between 65 and 80° F. where water solubility is relatively low, throughout the cleaning cycle the temperature of the fluid can be lowered to increase the solubility of the water in the bath. Water at the surfaces of the items will then partition into the bath. Conversely, the detergent can be injected into the densified $CO_2$ at a lower temperature where solubility is higher and the temperature can be raised to lower water solubility, resulting in partitioning of water from the bath to the fabric throughout the cleaning cycle.

Figure 2:
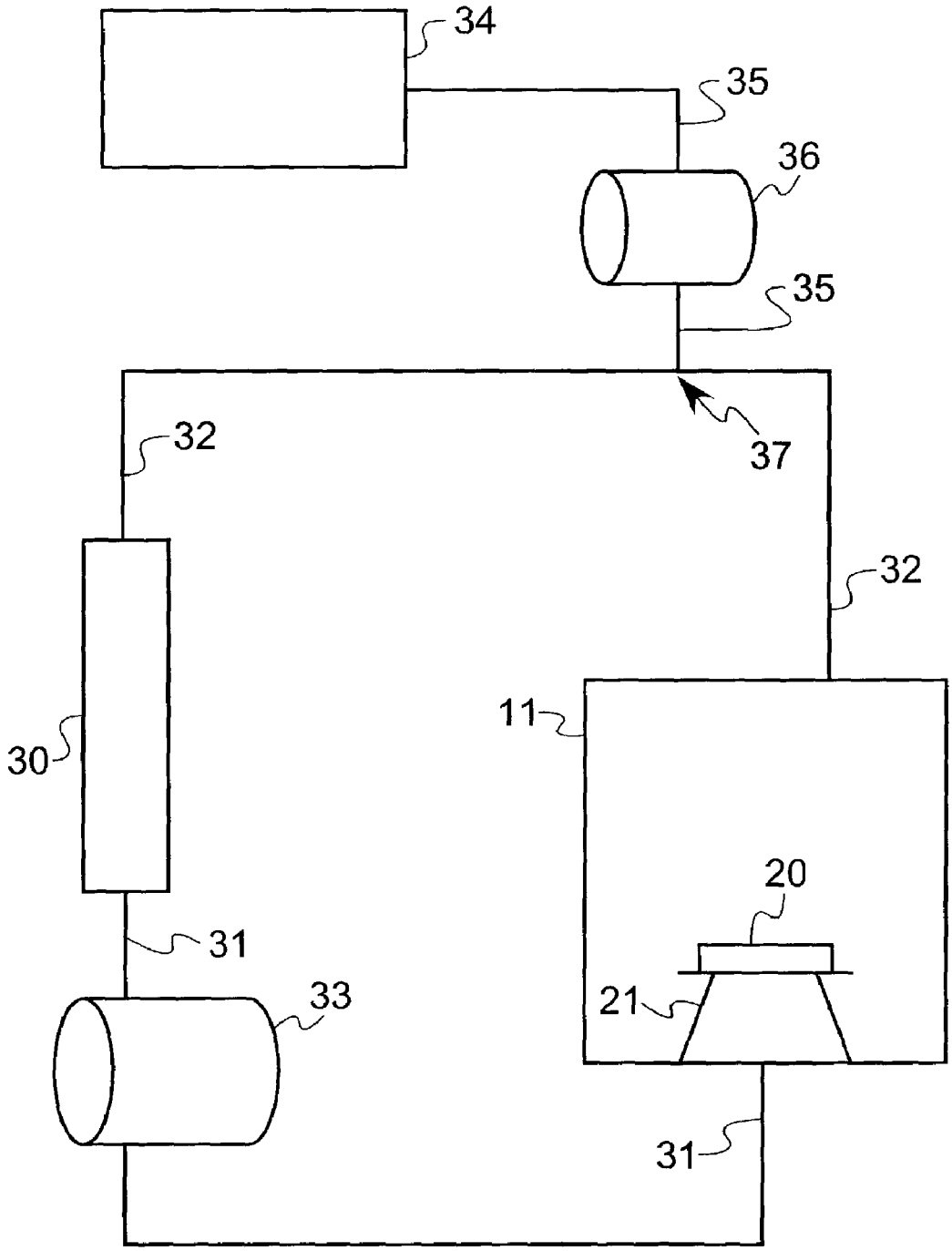
FIG. 2 schematically illustrates an apparatus for the introduction of detergent formulations into a microelectronic substrate processing chamber under turbulent conditions.

Systems for the addition of aqueous (or nonaqueous) detergent formulations and the like to a carbon dioxide microelectronic substrate cleaning system under turbulent or high shear conditions are disclosed in FIG. 2. These systems comprise a microelectronic substrate processing chamber 11 that is configured to contain therein at least one microelectronic substrate 20, as described in connection with FIG. 1 above. In addition, these systems include a filter 30, a carbon dioxide cleaning solution drain line 31 interconnecting the microelectronic substrate processing chamber to the filter, a carbon dioxide cleaning solution supply line 32 connecting the filter to the microelectronic substrate processing chamber, and a high pressure pump 33 operably connected to the drain line. The filter may be a carbon filter and/or any other suitable filter.

A detergent formulation reservoir 34 is provided, with a detergent formulation supply line 35 connecting the reservoir to the carbon dioxide cleaning solution supply line. A second high pressure pump 36 operably connected to the detergent formulation supply line is provided to transfer detergent formulation from the detergent formulation reservoir into the carbon dioxide cleaning solution under high shear conditions.

High pressure pumps simply refer to pumps that are capable of pumping densified carbon dioxide. The closed system and maintaining the temperature below 31 degrees Centigrade can ensure that the $CO_2$ remains densified. Impeller pumps (or centrifugal or rotating vane pumps), suitable for the first high pressure pump, may not operate under conditions where there can be significant differential pressures across the pump. Where there is a significant pressure differential across the pump (as in the second high pressure pump), such pumps are typically positive displacement pumps such as piston pumps or diaphragm pumps.

In an alternative embodiment, the detergent formulation supply line 35 could be connected to the drain line 31, but the detergent formulation would then pass through the filter and potentially be depleted on the filter. Optionally, control valves and a bypass line, dead-head, or other bypass means can be provided to bypass the filter during addition of the formulation.

In operation, the aforesaid apparatus provides methods of adding a detergent formulation to a carbon dioxide dry cleaning system. In operation, a continuous stream of densified carbon dioxide cleaning solution is pumped from the microelectronic substrate processing chamber through the filter and back to the microelectronic substrate processing chamber to clean microelectronic substrates in the microelectronic substrate processing chamber, and the detergent formulation is added into the continuous stream of densified carbon dioxide at a point downstream of the filter and upstream of the microelectronic substrate processing chamber at junction 37 to introduce the detergent formulation. Since pumping of the continuous stream by the first pump 33 is preferably carried out at a rate of about 0.5 to about 10 gallons per minute, turbulence will occur at least at the junction 37 when the detergent formulation is pumped into the stream. Those skilled in the art will appreciate how to specifically configure size and shapes of the pipes and the rate of pumping of the detergent formulation and continuous stream to facilitate turbulence and corresponding mixing.

Figure 3:
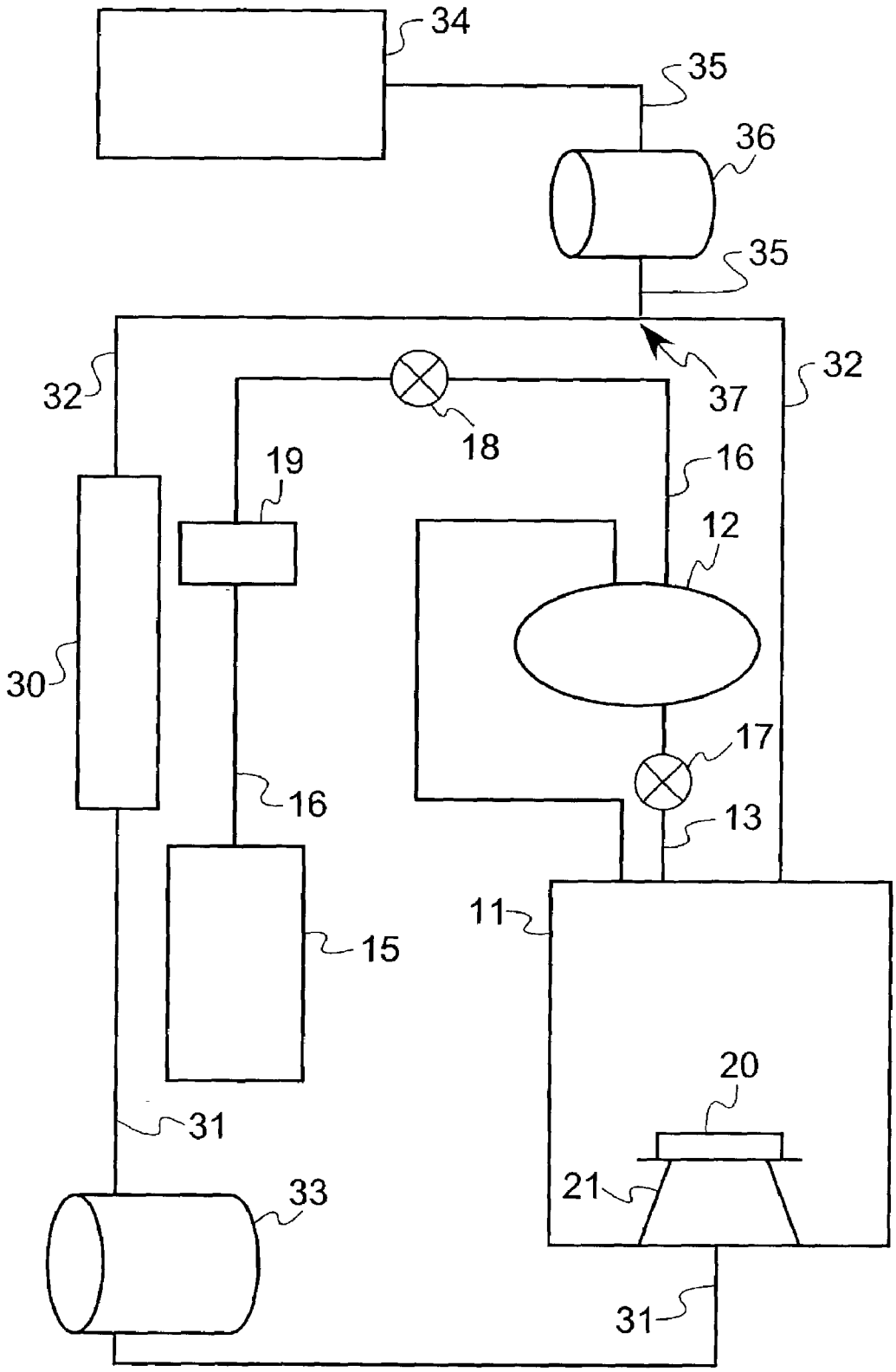
FIG. 3 illustrates a combined apparatus which separately provides for both the controlled introduction of detergent formulations into the microelectronic substrate processing chamber, and for the introduction of detergent formulations into the microelectronic substrate processing chamber under turbulent conditions.

FIG. 3 represents an apparatus that employs both the system described in FIG. 1 and the system described in FIG. 2. Since many cleaning operations incorporate different types of surfactants, some of which may be maintained in the densified carbon dioxide in significant quantities from cleaning to cleaning and others of which may be depleted onto the microelectronic substrate to be cleaned and/or the filters from cleaning cycle to cleaning cycle, the combination of both types of detergent formulation addition systems is advantageous, particularly where different formulations are added through each addition system. Like parts in FIG. 3 are assigned like numbers as compared to FIGS. 1 and 2 above.

8. Additional Drain Control Systems.

Figure 4:
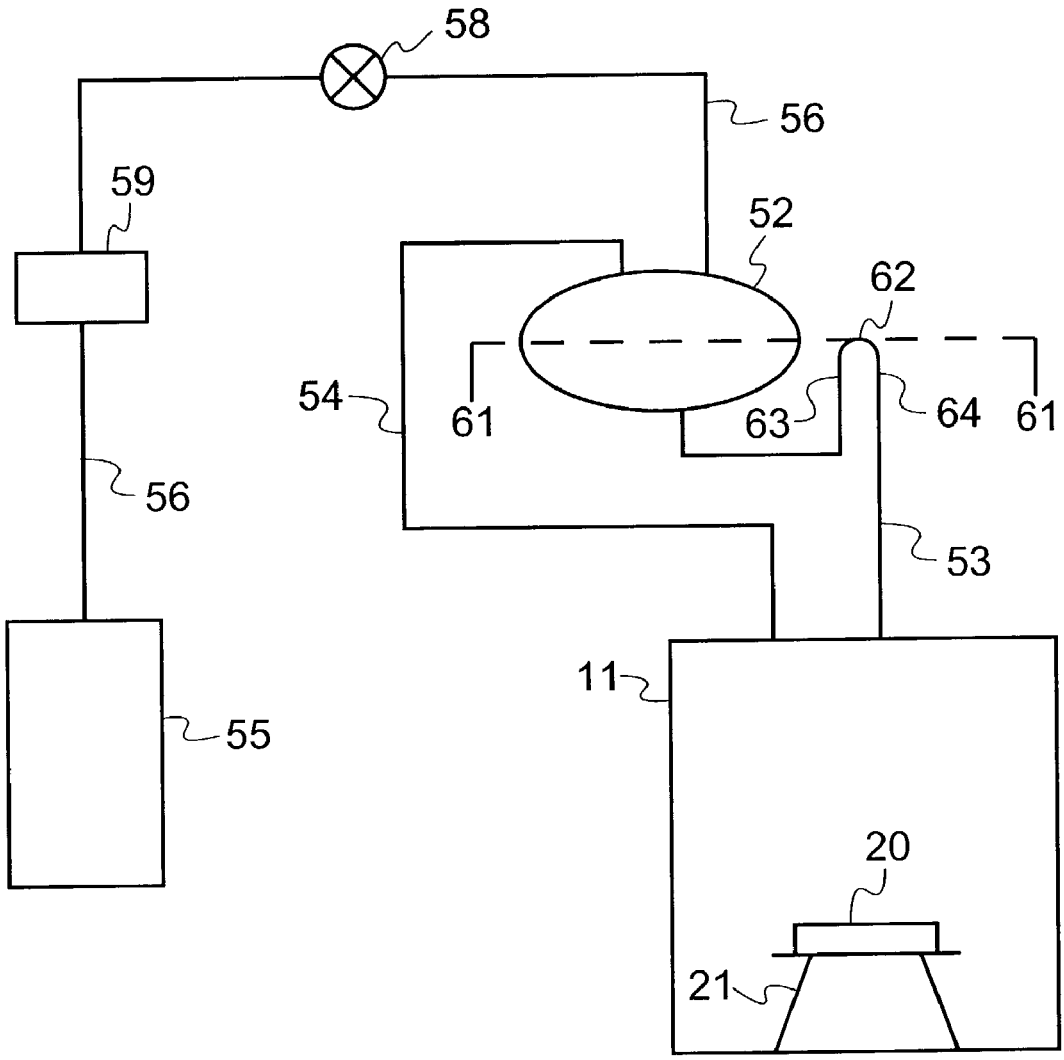
FIG. 4 is a further embodiment of the present invention similar to that of FIG. 1, with an alternate drain control system.

FIG. 4 illustrates an apparatus similar to FIG. 1, except that different drain control systems are provided. These systems comprise a high pressure microelectronic substrate processing chamber 11 (i.e., a microelectronic substrate processing chamber that is capable of containing densified carbon dioxide), an auxiliary vessel 52, and a drain line 53 connecting the auxiliary vessel to the microelectronic substrate processing chamber. The auxiliary vessel is positioned above the microelectronic substrate processing chamber so that the contents of the auxiliary vessel can be transferred by gravity to the microelectronic substrate processing chamber. Optionally, but preferably, a vent line 54 connects the auxiliary vessel to the microelectronic substrate processing chamber to provide gas-side communication therebetween. A detergent reservoir 55 is provided, and a detergent supply line 56 is provided connecting the detergent reservoir to the auxiliary vessel. Valve 58 is provided to control the system, typically by closing the valve during the substrate cleaning cycle or whenever the microelectronic substrate processing chamber is pressurized. A pump 59, which is preferably an inexpensive, low pressure pump, is provided to fill the auxiliary vessel from the detergent reservoir.

The drain line contains a raised portion 62 which functions as a valve, with a corresponding inlet portion 63 and outlet portion 64. The system uses a low pressure pump on the detergent supply system, so that the auxiliary vessel can be at essentially ambient pressure when it is being filled, and likewise the microelectronic substrate processing chamber can be at essentially ambient pressure. When the level of detergent in the auxiliary vessel goes above the level of the raised portion 62, represented by line 61, then the contents of the auxiliary vessel raises in inlet portion 63 through the raised portion 62 is siphoned into the microelectronic substrate processing chamber through outlet portion 64. In an alternative, the detergent in the auxiliary vessel can be raised to the raised level but not above the raised level and $CO_2$ gas can be pumped into the microelectronic substrate processing chamber to swell the detergent formulation, bring it above the raised level and cause the detergent formulation to drain into the microelectronic substrate processing chamber.

Figure 5:
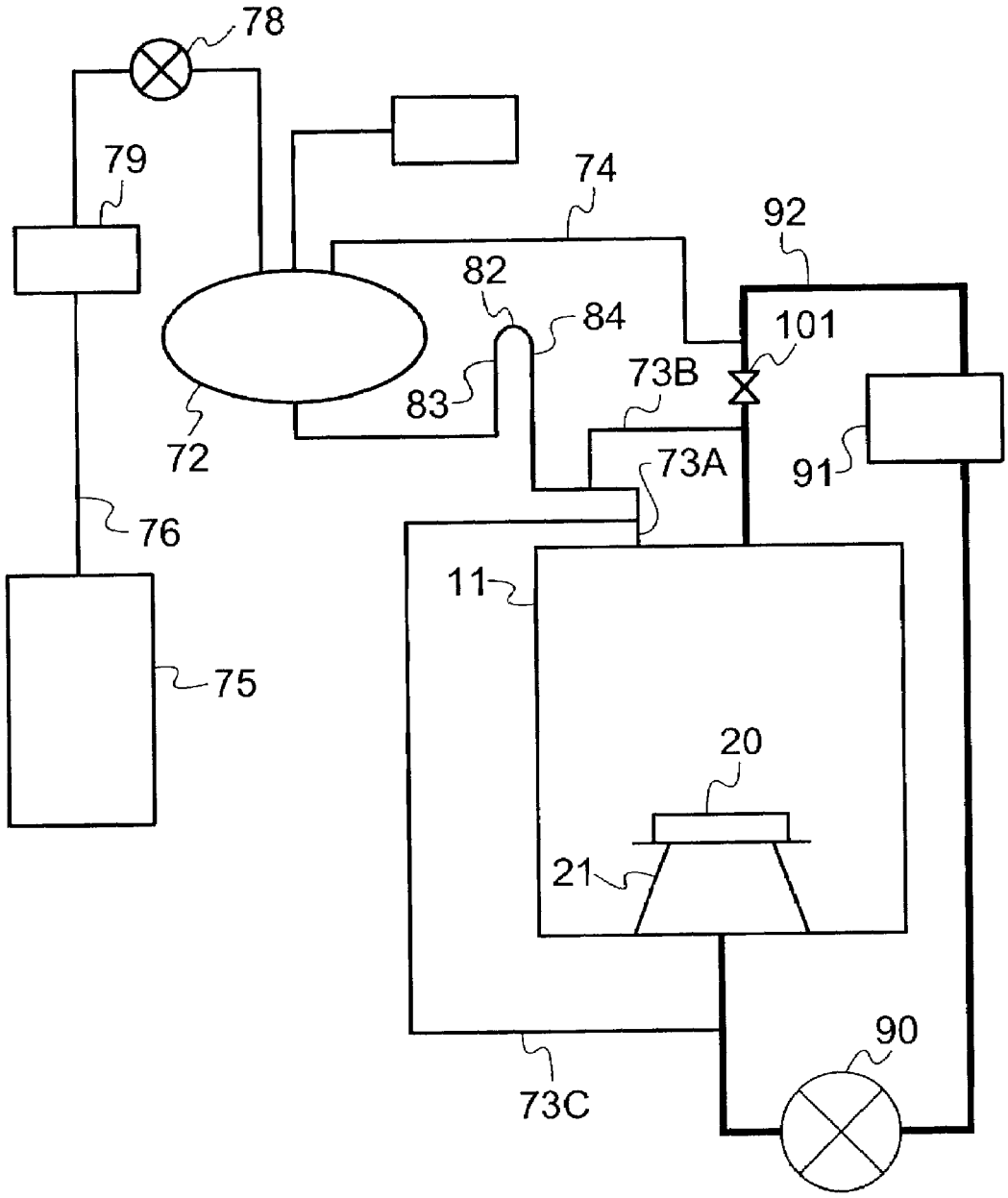
FIG. 5 is a further embodiment of the present invention, with several alternate drain control systems.

A still further embodiment is illustrated by FIG. 5. These systems are similar to that of FIG. 4, but differ in how it the auxiliary vessel empties, and in fact illustrates a variety of different emptying mechanisms, any one or more of which could be implemented. The system comprises a high pressure microelectronic substrate processing chamber 11 (i.e., a microelectronic substrate processing chamber that is capable of containing densified carbon dioxide), an auxiliary vessel 72, and a drain line 73 connecting the auxiliary vessel to the microelectronic substrate processing chamber. The auxiliary vessel is again positioned above the microelectronic substrate processing chamber. A vent line which also serves as a back pressure line 74 connects the auxiliary vessel to the microelectronic substrate processing chamber to provide gas-side communication therebetween. A detergent reservoir 75 is provided, and a detergent supply line 76 is provided connecting the detergent reservoir to the auxiliary vessel. Valve 78 is provided to control the system, typically by closing the valve during the cleaning cycle. A pump 79, which is preferably an inexpensive, low pressure pump, is provided to fill the auxiliary vessel from the detergent reservoir. The drain line contains a raised portion 82 which functions as a valve as in FIG. 4 above, with a corresponding inlet portion 83 and outlet portion 84. In this case, however, as will be apparent from the detergent transfer mechanism described below, all that may be required is that the auxiliary vessel not drain by gravity prior to its contents being pushed into the microelectronic substrate processing chamber; thus, the raised portion in the drain line could be eliminated, and the auxiliary vessel simply positioned below the microelectronic substrate processing chamber. The system of FIG. 5 further includes a high pressure pump 90 and filter 91 through which the carbon dioxide cleaning medium is cycled via line 92 during the cleaning cycle.

There are three options by which the contents of auxiliary vessel 72 may be transferred to microelectronic substrate processing chamber 11, as follows:

(A) First, simple back pressure from valve 101 (or other backpressure means such as a constricted section of pipe) from flow through line 74 into tank 72 will flush the contents of the auxiliary tank into the microelectronic substrate processing chamber via line 73A.

(B) In addition or in alternative to the foregoing, line 74B could be provided so that the detergent formulation in auxiliary vessel 72 is co-mixed with the main carbon dioxide fluid in line 92 before it is returned to microelectronic substrate processing chamber 11.

(C) Finally, in addition to or in alternative to the foregoing, line 73C may be provided and the flush stream from the auxiliary vessel and combined with the main carbon dioxide in line 92 prior to (as illustrated) or after the high pressure pump 90.

In all of the foregoing, in alternative to using a flush line through line 74, a gas inlet line 102 from a high pressure gas source 103 (e.g., a system still, the gas side of a compressor, a compressed gas vessel, etc.), and high pressure gas allowed to enter the auxiliary vessel to flush or push the contents thereof into the microelectronic substrate processing chamber 11 or line 92. In addition to or in alternative to the foregoing, a heater (not shown) can be provided in operative association with the auxiliary vessel to heat the contents of the auxiliary vessel and cause the contents thereof to expand into the microelectronic substrate processing chamber or line 92.

While the present invention is described above with the use of a high pressure pump for pumping densified carbon dioxide from the microelectronic substrate processing chamber drain line through a filter and back to the microelectronic substrate processing chamber, it will be appreciated that other fluid transfer means for transferring the densified carbon dioxide, microelectronic substrate processing chamber can also be employed as an alternate to, or as a supplement to, a high pressure pump. Such other fluid transfer means include, but are not limited to, a system for supplying a second compressed gas to push the densified carbon dioxide from one location to another in the system as described in U.S. Pat. No. 5,412,958 to Iliff et al., and the use of multiple pressure tanks as described in U.S. Pat. No. 5,904,737 to Preston et al., the disclosures of both of which are incorporated by reference herein in their entirety.

9. Cleaning.

The details of the overall cleaning process will depend upon the particular apparatus employed, as discussed in greater detail above. In practice, in some embodiments of the invention, a microelectronic substrate to be cleaned and a densified carbon dioxide cleaning composition as given above are combined in a microelectronic substrate processing chamber. The densified carbon dioxide cleaning composition is preferably provided in an amount so that the microelectronic substrate processing chamber contains a supercritical phase exclusively. The cleaned substrate is then removed from the microelectronic substrate processing chamber. The article may optionally be rinsed (for example, by removing the composition from the microelectronic substrate processing chamber, adding a rinse solution such as densified $CO_2$ (with or without additional ingredients such as water, co-solvent, etc.) to the microelectronic substrate processing chamber, removing the rinse solution, and repeating as desired), before it is removed from the microelectronic substrate processing chamber. The dry cleaning compositions and the rinse solutions may be removed by any suitable means, including both draining and/or venting.

Figure 6:
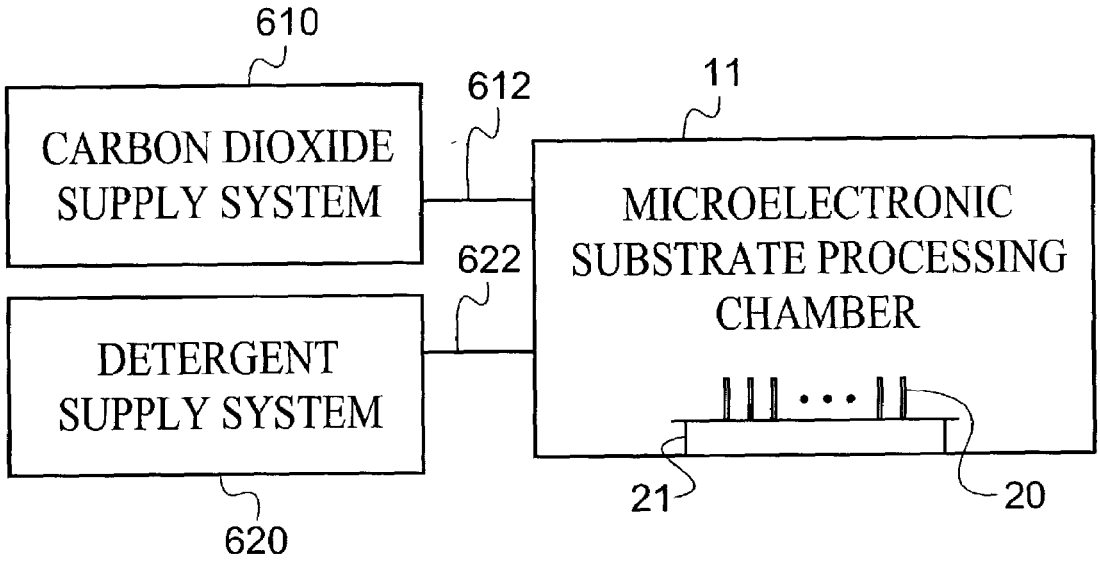
FIG. 6 is a block diagram of other microelectronic substrate processing systems according to some embodiments of the present invention.

FIG. 6 is a block diagram of other microelectronic substrate processing systems according to some embodiments of the present invention. In particular, as shown in FIG. 6, a microelectronic substrate processing chamber 11 is configured to contain therein at least one microelectronic substrate 20 on a microelectronic substrate holder 21. As shown in FIG. 6, a plurality of microelectronic substrates 20 may be held in a vertical orientation using, for example, a conventional wafer boat.

Still referring to FIG. 6, a carbon dioxide supply system 610 is configured to supply densified carbon dioxide to the microelectronic substrate processing chamber 11. A detergent supply system 620 is configured to supply detergent to the microelectronic substrate processing chamber 11.

FIG. 6 also illustrates other embodiments of the present invention wherein the microelectronic substrate processing chamber 11 includes a first supply line 612, and a second supply line 622. The carbon dioxide supply system 610 is configured to supply densified carbon dioxide to the microelectronic substrate processing chamber 11 via the first supply line 612, and the detergent supply system 620 is configured to supply detergent to the microelectronic substrate processing chamber 11 via the second supply line 622.

Figure 7:
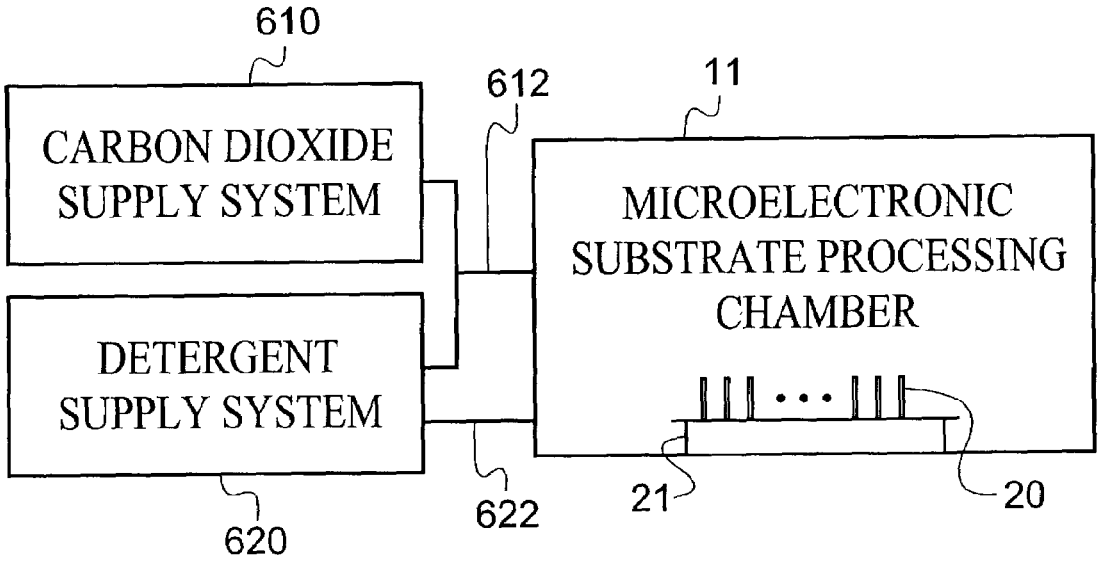
FIG. 7 is a block diagram of still other microelectronic substrate processing systems according to still other embodiments of the present invention.

FIG. 7 is a block diagram of microelectronic substrate processing systems according to still other embodiments of the present invention. As shown in FIG. 7, the microelectronic substrate processing chamber includes a supply line 612. In some embodiments, as shown in FIG. 7, the carbon dioxide supply system 610 is configured to supply densified carbon dioxide to the microelectronic substrate processing chamber 11 via the supply line 612, and the detergent supply system 620 also is configured to supply detergent to the processing chamber 11 via the supply line 612. In still other embodiments of the invention, as also illustrated in FIG. 7, the supply line 612 is a first supply line and the detergent supply system 620 also is configured to supply detergent to the microelectronic substrate processing chamber 11 via a second supply line 622, in addition to via the first supply line 612. Detailed embodiments of FIGS. 6 and 7 may be provided, as was described above in connection with FIGS. 1–5.

The present invention is explained in greater detail in the following non-limiting examples.

EXAMPLE 1

A microelectronic substrate is fabricated by forming a low dielectric constant (low k) material on a microelectronic substrate, such as a silicon semiconductor substrate. The low k material may comprise conventional silicon dioxide and/or silicon nitride dielectrics. In other embodiments, a low k dielectric that is suitable for integrated circuit copper metallization may be used. These low k dielectric materials may comprise silicon dioxide doped with carbon, to provide a dielectric constant of between about 2.9 and about 2.6. Organic low dielectric materials and porous low dielectric materials, such as porous SiLk™ marketed by Dow Chemical, also may be provided with dielectric values approaching 2.0. The use of densified $CO_2$ for cleaning porous dielectrics may be desirable, because it may be difficult to clean these porous low k dielectrics using conventional cleaning techniques.

A cleaning formulation used to remove low k dielectric etch residues and/or photoresist residues from the microelectronic substrate is injected into a high pressure $CO_2$-based microelectronic substrate cleaning apparatus as was described above in connection with, for example, FIG. 1. This apparatus can include a microelectronic substrate processing chamber 11, an auxiliary vessel 12, a drain line 13 connecting the auxiliary vessel to the microelectronic substrate processing chamber, a vent line 14 connecting the auxiliary vessel to the microelectronic substrate processing chamber, a detergent reservoir 15, a detergent supply line 16 connecting the detergent reservoir to the auxiliary vessel and associated valves 17, 18, controls and $CO_2$ as was already described.

Initially, a clean formulation is charged from the detergent reservoir 15 to the auxiliary vessel 12 at atmospheric pressure. $CO_2$ fluid is added to the microelectronic substrate processing chamber 11, the auxiliary vessel 12 and associated lines and valves. The microelectronic substrate 20 is then exposed to densified carbon dioxide containing detergent by first opening one or more valves 17, 18 between the auxiliary vessel 12 and the chamber 11 in either or both of the drain line 13 or the vent line 14 connecting the microelectronic substrate processing chamber 11 and the auxiliary vessel 12. Fluid containing the cleaning formulation comes into contact with the microelectronic substrate 20 by gravity draining of the carbon dioxide fluid with cleaning formulation into the substrate, diffusion of the cleaning formulation through the carbon dioxide fluid in the microelectronic substrate processing chamber and/or by dynamic force caused by fluid motion.

EXAMPLE 2

A cleaning formulation used to remove etch residues from a low k dielectric etched microelectronic substrate is injected into a high pressure densified carbon dioxide based cleaning apparatus that was described, for example, in connection with FIG. 2. The apparatus can include a microelectronic substrate processing chamber 11, a filter 30, a pump 33 for adding carbon dioxide to the chamber and for circulating fluid through the filter and back into the chamber, a cleaning formulation reservoir 34 and associated valves, lines monitors and controls, and a carbon dioxide supply. Initially, carbon dioxide fluid is pumped into the microelectronic substrate processing chamber 11 and associated processing components including the filter 30, and a cleaning formulation supply line 32 and a cleaning formulation drain line 31. Valves are actuated and a pump is activated to circulate fluid between the filter and the cleaning chamber using a carbon dioxide cleaning formulation supply line and a carbon dioxide cleaning formulation drain line.

When fluid is circulated, a second pump 36 adds a cleaning formulation containing co-solvents, surfactant and water from the reservoir 34 to the carbon dioxide cleaning formulation supply line 32. Through fluid flow and mixing facilitated by the filter 30, the detergent becomes homogenized prior to contacting the microelectronic substrate 20. After a time sufficient for the formulation to act on the substrate, the processing fluid is removed from the microelectronic device processing chamber 11 to an abatement system and pure carbon dioxide is added to the supply route to rinse the substrate. After sufficient rinsing, the processing loop and microelectronic substrate processing chamber containing a substrate are vented to atmospheric conditions and the substrate is removed.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A microelectronic substrate processing method comprising:

providing microelectronic substrate processing chamber that is configured to perform a microelectronic fabrication process on at least one microelectronic substrate that is contained therein;

supplying densified carbon dioxide to the microelectronic substrate processing chamber from a carbon dioxide supply system, the densified carbon dioxide being used to perform the microelectronic fabrication process on the microelectronic substrate that is contained in the microelectronic substrate processing chamber; and supplying detergent to the microelectronic substrate processing chamber from a detergent supply system, the detergent being used to perform the microelectronic fabrication process on the microelectronic substrate that is contained in the microelectronic substrate processing chamber; and providing an auxiliary vessel that is separate from the microelectronic substrate processing chamber;

wherein supplying detergent comprises:

reducing pressure in said microelectronic substrate processing chamber and said auxiliary vessel; then adding a detergent formulation to said auxiliary vessel; then increasing the pressure in said microelectronic substrate processing chamber so that densified carbon dioxide can be pumped therethrough to clean the at least one microelectronic substrate in said microelectronic substrate processing chamber; and then transferring said detergent formulation from said auxiliary vessel to said microelectronic substrate processing chamber to facilitate the cleaning of the at least one microelectronic substrate therein.

2. A method according to claim 1, wherein said adding and transferring steps are carried out while maintaining gas-side communication between said microelectronic substrate processing chamber and said auxiliary vessel.

3. A method according to claim 1, wherein said transferring step is carried out by gravity drainage.

4. A method according to claim 1, wherein said adding step is carried out by pumping said detergent formulation into said auxiliary vessel.

5. A method according to claim 1, wherein said pumping step is carried out with a low pressure pump.

6. A method according to claim 1 wherein said detergent formulation comprises a co-solvent and a surfactant.

7. A method according to claim 1 wherein the densified carbon dioxide consists of supercritical carbon dioxide.

8. A microelectronic substrate processing system comprising:

a microelectronic substrate processing chamber that is configured to perform a microelectronic fabrication process on at least one microelectronic substrate that is contained therein;

a carbon dioxide supply system that is configured to supply densified carbon dioxide to the microelectronic substrate processing chamber that is used in performing the microelectronic fabrication process on the microelectronic substrate that is contained therein; and a detergent supply system that is configured to supply detergent to the microelectronic substrate processing chamber that is used in performing the microelectronic fabrication process on the microelectronic substrate that is contained therein;

wherein the microelectronic substrate processing chamber includes a first supply line and a second supply line, wherein the carbon dioxide supply system is configured to supply densified carbon dioxide to the microelectronic substrate processing chamber via the first supply line and wherein the detergent supply system is configured to supply detergent to the microelectronic substrate processing chamber via the second supply line;

wherein the detergent supply system comprises:

an auxiliary vessel that is connected to the microelectronic substrate processing chamber by the second supply line;

a vent line connecting The auxiliary vessel to the microelectronic substrate processing chamber;

a detergent reservoir;

a detergent supply line connecting the detergent reservoir to the auxiliary vessel; and a drain control system operatively associated with the second supply line and configured to control a time of draining of detergent formulation from the auxiliary vessel into the microelectronic substrate processing chamber.

9. A system according to claim 8, further comprising a low-pressure pump operatively associated with said detergent supply line and configured to transfer detergent from said reservoir to said auxiliary vessel.

10. A system according to claim 9, wherein said low-pressure pump is a peristaltic pump or a piston pump.

11. A system according to claim 8, wherein said drain control system comprises a drain valve.

12. A system according to claim 11, wherein said auxiliary vessel is positioned above said microelectronic substrate processing chamber so that detergent formulation can be transferred from said auxiliary vessel to said microelectronic substrate processing chamber by gravity.

13. A system according to claim 8 wherein the densified carbon dioxide consists of supercritical carbon dioxide.

14. A system according to claim 8 wherein the detergent supply system further comprises:

a filter;

a carbon dioxide cleaning solution drain line and a carbon dioxide cleaning solution supply line interconnecting The microelectronic substrate processing chamber to the filter;

a first high pressure carbon dioxide transfer system operably associated with the drain line;

a detergent formulation reservoir;

a detergent formulation supply line connecting the reservoir to the carbon dioxide cleaning solution supply line or drain line; and a second high pressure carbon dioxide transfer system operably connected to the detergent formulation supply line and configured to transfer detergent formulation from the detergent formulation reservoir into the carbon dioxide cleaning solution under turbulent conditions.

15. A system according to claim 14, wherein said filter comprises a carbon filter.

16. A system according to claim 14, wherein said first high pressure liquid transfer system comprises a pump.

17. A system according to claim 14, wherein said second high pressure liquid transfer system comprises a piston or diaphragm pump.

* * * * *